United States Patent [19]

Peart et al.

[11] 4,164,643

[45] Aug. 14, 1979

[54] ENERGY-EFFICIENT BI-RADIANT OVEN SYSTEM

[76] Inventors: M. Virginia Peart, 1974 Indian Trail Dr.; David P. DeWitt, 3303 Georgton Rd., both of West Lafayette, Ind. 47906; Susan T. Kern, 102 Turner Hall, Illinois State University, Normal, Ill. 61761

[21] Appl. No.: 883,469

[22] Filed: Mar. 6, 1978

[51] Int. Cl.[2] ..... H05B 9/00

[52] U.S. Cl. ..... 219/411; 219/412; 426/243

[58] Field of Search ..... 219/397, 405, 411, 395, 219/356, 342, 396, 397-399; 99/451, 447; 426/243

[56] References Cited

U.S. PATENT DOCUMENTS

| | | | |
|---|---|---|---|
| 1,392,802 | 10/1921 | Serrell | 219/399 |
| 1,630,237 | 5/1927 | Smith | 219/399 |
| 2,778,914 | 1/1957 | Vallorani | 219/398 |
| 2,790,056 | 4/1957 | Fry | 219/398 |
| 2,824,943 | 2/1958 | Laughlin | 219/411 |
| 2,860,225 | 11/1958 | Steen | 219/411 |
| 2,864,932 | 12/1958 | Forrer | 219/411 |
| 3,131,280 | 4/1964 | Brussell | 219/411 |
| 3,249,741 | 5/1966 | Mills | 219/411 |
| 3,265,861 | 8/1966 | Perlman | 219/411 |
| 3,304,406 | 2/1967 | King | 219/411 |
| 3,414,709 | 12/1968 | Tricault | 219/411 |
| 3,626,155 | 12/1971 | Joeckel | 219/411 |
| 3,682,643 | 8/1972 | Foster | 219/411 |
| 3,820,525 | 6/1974 | Pond | 126/21 A |

FOREIGN PATENT DOCUMENTS

| | | | |
|---|---|---|---|
| 1160122 | 2/1962 | Fed. Rep. of Germany | 219/398 |

*Primary Examiner*—Roy N. Envall, Jr.
*Assistant Examiner*—Bernard Roskoski
*Attorney, Agent, or Firm*—Woodard, Weikart, Emhardt & Naughton

[57] ABSTRACT

A domestic electric baking oven system utilizing upper and lower independently controlled low temperature, low wattage radiant heating elements which radiate heat directly to a food product and to a baking pan bottom. The system efficiently couples the two radiant heat energy sources to the product by utilizing interior oven cavity walls that are highly reflective of radiant energy and a baking pan member that is highly absorptive of radiant energy. The system accomplishes shorter baking times and reduction in energy consumption while maintaining quality levels in the baked product.

12 Claims, 5 Drawing Figures

ENERGY-EFFICIENT BI-RADIANT OVEN SYSTEM

BACKGROUND OF THE INVENTION

This invention relates generally to domestic electric baking ovens. In a conventional oven, during the baking process, a thermostat switches a single high wattage element, located in the bottom of the oven, on and off to provide an average air temperature that has been preselected. Temperatures vary from 15°–30° C. on either side of the selected average air temperature. Element surface temperatures have been measured at 800° C. although the foods that are typically cooked in an oven are done at internal temperatures of 100° C. or below. Since the element is located at the bottom of the oven cavity a large amount of infrared radiation is directed toward the lower surface of a product or utensil in the oven thus resulting in the baking of food products from bottom to top.

The portions of the food that are exposed to the upper areas of the oven cavity are heated by convection as air circulates to the food after passing the hot element or by infrared radiation that has been absorbed by the oven cavity walls and top and is reradiated to the food. To function properly, the conventional oven requires use of an element rated at 2000–3000 watts. Thus, the cumbersome process of radiating, absorbing, reradiating and convecting heat results in unnecessarily high energy usage and longer than necessary baking times. The conventional system also requires a higher radiant element surface temperature to accomplish radiant heating of the cavity walls which in turn causes convective heating of air within the oven cavity.

In the conventional baking system, the vaporization of moisture at the upper surfaces of the food keeps those surfaces of the food cool and slows the cooking process in the food from the top down. To keep the lower surfaces of the food, the portions in contact with the pan, from overcooking and burning before the upper portions can get done, pans must be designed to reflect much of the infrared radiation presented to the bottom of the pan. For example, in cake pans recommended for electric ovens, the emissivity E is about 0.077 for a pan bottom and 0.05 for a pan side. Emissivity E is also equal to absorptivity of radiant energy. The pan side absorbs radiation a little less readily than the bottom to discourage overcooking of the edges of the food.

Preheating is important in the conventional electric oven system for many heat sensitive foods because it allows oven walls to absorb infrared radiation and become part of the cooking system by reradiating power to the upper portion of the product when it is placed in the oven to bake. Without preheating, oven walls absorb infrared radiation and become part of the cooking system later in the baking process. Conventional range ovens are patterned after older and less efficient range ovens in wood and coal stoves that were developed to harness the heat from unwieldy flames. Electric ovens were developed 60–70 years ago and their design has never been reviewed in light of the function they perform or the sophisticated and easily controlled energy source used.

Heretofore, various food heating and reheating systems using plural radiant sources have been designed as disclosed in U.S. Pat. Nos. 3,131,280 to Brussell; 3,414,709 to Tricault; 3,626,155 to Joeckel; 3,682,643 to Foster; and 3,820,525 to Pond. In order to accomplish the baking process, these systems provide for some combination of heating modes including conduction to the pan, forced or free convection to the pan and/or multiple products, and radiant power from high temperature sources. However, none of these systems have solved the problem of effectively coupling low temperature radiant heat sources to food products to thereby reduce heating time and energy consumption.

BRIEF SUMMARY OF THE INVENTION

The oven of this invention utilizes two relatively low wattage and low temperature radiant elements in the form of electrical resistance heaters located, respectively, in the upper and lower portions of the oven cavity. Power levels to the radiant elements are controlled independently to allow optimal wattage settings for various foods. Direct coupling, in the heat transfer sense, of the radiant energy sources predominantly in the thermal or infrared spectral regions to the food product is accomplished by utilizing interior oven cavity walls which are highly reflective of radiant energy (i.e., have low emissivity) and a product pan that his highly absorptive of radiant energy. Direct coupling of the radiant energy sources to the product enables usage of a low power, low temperature, typically 150°–350° C., radiant source thus reducing energy consumption. The direct coupling also results in shorter baking times while maintaining product quality. While both radiant elements are relatively low temperature (wattage), in a typical baking operation the upper element is set at a higher temperature (wattage) level than the lower element to compensate for the cooler top surface of a food due to evaporative heat losses. Since low levels of heat are presented in the bi-radiant oven, thermostatic cycling is not necessary. Furthermore, it is practical to program the electrical power to the heating elements so that optimal heat rates to products being baked as a function of time are permissible.

Accordingly, it is an object of the invention to provide an energy-efficient oven system wherein direct coupling of electric radiant heat sources with a food product is assisted by altering the conventional function of the oven cavity walls and baking pan material.

It is an object of the invention to use, as the dominant heat transfer mode, radiant energy in the form of low temperature, low wattage radiant energy sources to present radiant energy to the product in such a fashion that a high quality product will result.

It is a further object of the invention to substantially reduce the radiant heat absorption and reradiation process by cavity walls of conventional baking oven systems.

It is a further object of the invention to eliminate the energy wasteful preheat period required in the conventional oven.

It is also an object of the invention to allow the use of a 120V service for a separate oven installation rather than the 240V service required for operation of conventional ovens.

It is also an object of the invention to bake a product in less time than required in a conventional oven without loss of quality.

It is a further object of the invention to operate the radiant heat source elements on a continuous basis thus obviating the problems encountered with thermostatic on-off cycling of a high wattage element.

It is a further object of the invention to reduce high heat transfer convection coefficients that are necessary in order to heat the top of products being baked in conventional or convection ovens which have the adverse effect of drying product exposed surfaces.

Further objects and advantages of the present invention will become apparent as the following description proceeds, and the features of novelty characterizing the invention will be pointed out with particularity in the claims annexed to and forming a part of this specification.

BRIEF DESCRIPTION OF THE DRAWINGS

For a better understanding of the present invention, reference may be had to the accompanying drawings wherein the same reference numerals have been applied to like parts and wherein.

DESCRIPTION OF THE PREFERRED EMBODIMENT

Figure 1:
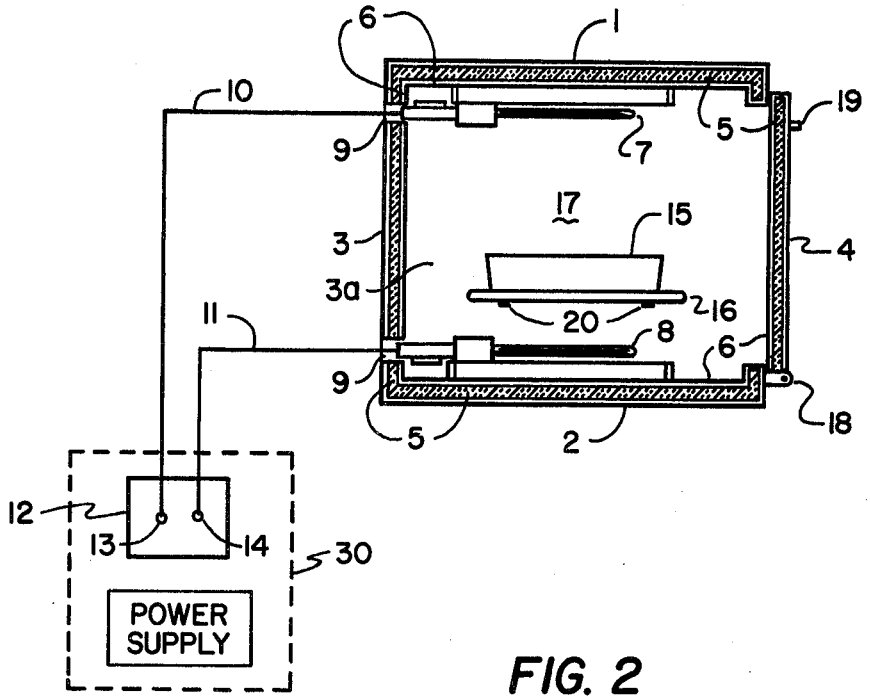
FIG. 1 is a side view of the invention oven with one side wall cut away to expose the oven cavity and components therein. Also, the figure illustrates in schematic form the independent control of wattage values for the upper and lower radiant elements.
Figure 2:
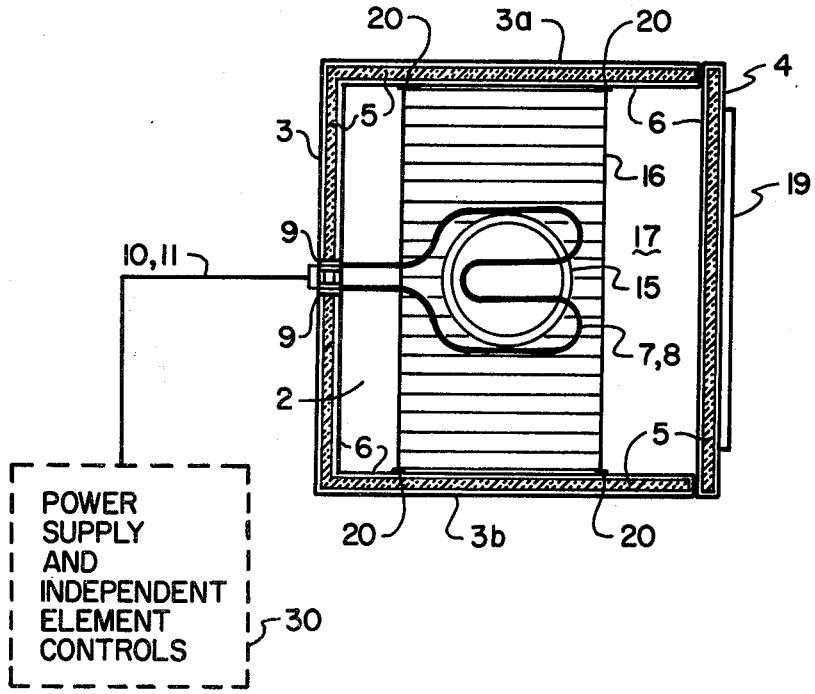
FIG. 2 is a top view of the invention oven with the top wall cut away to expose the interior oven cavity.

Referring now to the drawings and, in particular, to FIGS. 1 and 2, the bi-radient oven of the invention is shown having top outer wall 1, bottom outer wall 2 and side outer wall 3, 3*a* and 3*b*. A fourth side wall has an oven door therein with outer wall 4 which has handle 19 mounted thereon in a conventional manner. A minimal layer of insulation 5 lines the walls and door as is known in the baking oven art. Inner cavity walls 6, which include the inner portion of the oven door in its closed position, are constructed of a metal that will provide surfaces highly reflective of radiant power in the thermal or infrared spectral region. In tests conducted on the invention oven, a shiny aluminum metal was used but other metals having similar radiantly reflective properties may be utilized. The oven lining metal 6 should have an emissivity value on the order of E=0.05, thus being highly reflective. A first source of radiant heat 7 is shown located in the upper portion of oven cavity 17 with a second source of radiant heat 8 being located in the lower portion of oven cavity 17 so as to lie beneath horizontal rack member 16. Sources of radiant heat 7 and 8 consist of relatively low wattage electrical resistance elements operating at low temperatures compared to that used in conventional ovens. Rack 16 which can extend the full depth of the oven is supported in its horizontal position by rack-retaining members 20. Baking pan 15, shown resting upon rack 16, is constructed of metal coated so as to be highly absorptive of radiant heat. In tests conducted on the invention oven, a black coated aluminum pan was used with an emissivity of E=0.79 but it should be understood that other materials with similarly high absorptive properties may be effectively utilized. The oven of the present invention may also have an air vent, not shown, contained therein. Radiant elements 7 and 8 are supported by retainer members 9 and are supplied power via lines 10 and 11. Lines 10 and 11 terminate in wattage supply and control member 30 which comprises a standard domestic power supply and control member 12 by means of which, through dial members 13 and 14, the wattage level of radiant sources 7 and 8 may be controlled independently of each other. Such independent control allows optimal adjustment of upper and lower elements 7 and 8 for a variety of food products to be baked.

In operation, upper radiant source 7 is typically set at a higher wattage level than lower radiant source 8 to compensate for the cooler upper surface of a food product due to the evaporative heat losses at the top portion thereof. In tests conducted using the invention oven, most foods were effectively baked with an upper element range of 500–700 watts and a lower element range of 100–200 watts. In practice of the invention, slightly higher wattage rated elements could be used. For example, maximum wattage ratings for upper and lower elements could be selected at 1000 and 500 watts respectively. After wattage level dial members 13 and 14 have been set for a particular food product, control member 12 provides continuous operation of radiant elements 7 and 8 at the desired wattage levels. Thus, the thermostatic on-off element cycling of the conventional oven, and accompanying switching complexity, is avoided. Radiant energy from lower radiant source 8 either directly strikes the sides and bottom of pan 15 or is reflected from walls 6 back into oven cavity 17. Only a very small percentage of the radiant energy striking the oven walls is absorbed by said walls, in contrast to the conventional oven and hence only minimal insulation is required. Radiant heat from source 7 either directly strikes the food product being baked or is reflected from walls 6 back into oven cavity 17. In experimental tests conducted on yellow cakes, with an upper/lower wattage setting of 670/100, surface temperatures for the upper and lower radiant elements were approximately 340° C. and 120° C. respectively, as opposed to a conventional oven element surface temperature of approximately 800° C. In practice of the invention, it is contemplated that maximum operating temperatures for upper and lower radiant elements would be 400° C. and 200° C. respectively. Decreasing element temperatures, directing radiant energy to the product being baked by the reflective oven interior and encouraging radiant energy absorption through the use of highly absorptive pans permits the invention oven to consume less energy and reduces the interior/exterior oven temperature differential required to promote heat transfer in a conventional oven.

Figure 3:
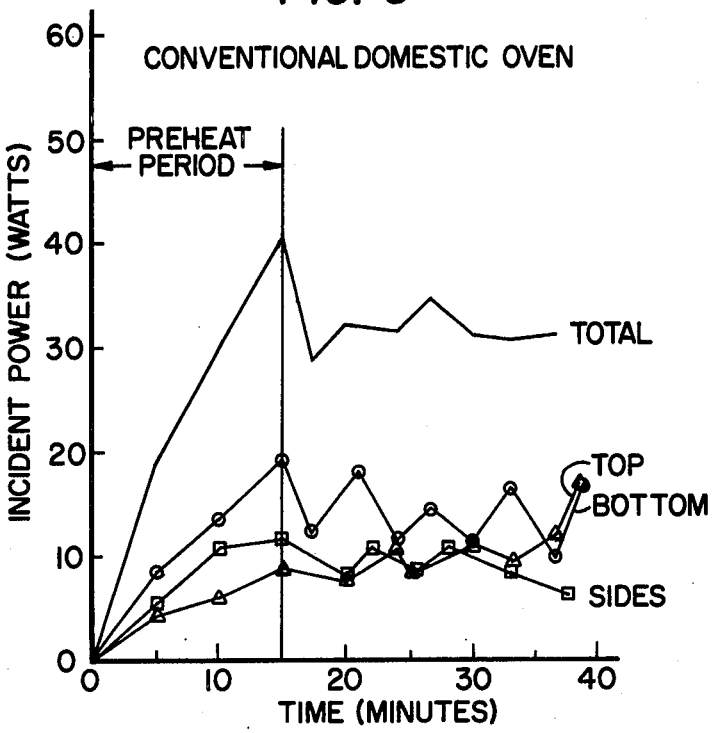
FIG. 3 is a graph illustrating, in a conventional oven, radiant power incident upon the top, bottom and sides of a food product.
Figure 4:
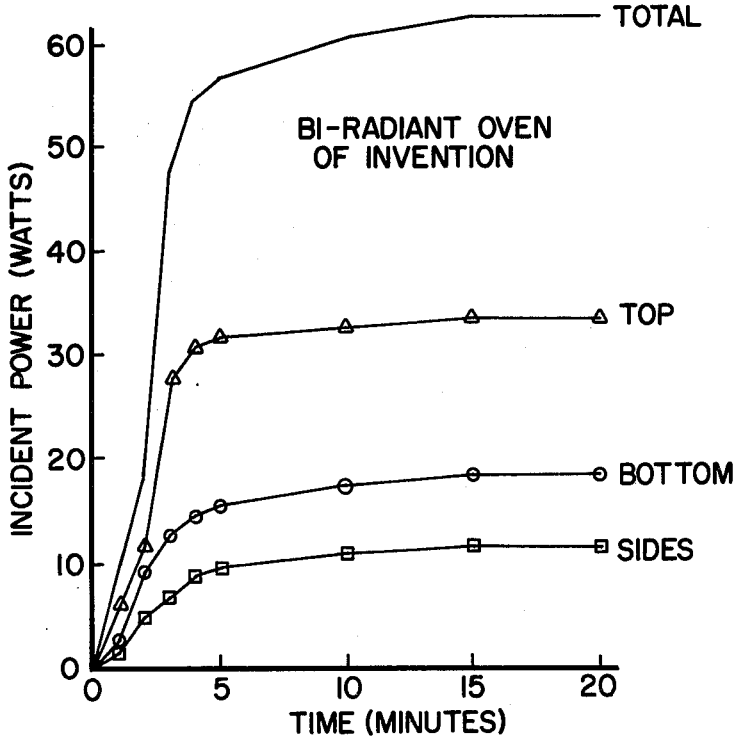
FIG. 4 is a graph illustrating, for the invention oven, radiant power incident on the top, bottom and sides of a food product.

The advantageous operation of the present invention is illustrated by reference to FIGS. 3 and 4. FIG. 3 shows a graph of radiant power (in watts) incident upon the top, bottom and sides of a cake pan and cake surface in a conventional domestic oven system at 350° F. FIG. 4 shows a graph of radiant power (in watts) incident upon the top, bottom and sides of a cake pan and cake surface in the invention oven. A cake pan radiometer previously developed at the Consumer Sciences and Retailing Department at Purdue University was utilized to obtain data for FIGS. 3 and 4. In the conventional oven, more radiant energy was presented to the bottom surface of the cake pan than to either sides or the top cake surface. This was the expected result for a conventional electric oven with a single lower element since the top surface of the cake received primarily only radiant energy that had been absorbed and reradiated from the walls of the oven. Total radiant power available in the conventional construction is shown to be approximately 30 watts. The remainder of cooking energy must be supplied by the convective mode throughout a longer cooking time. In the bi-radiant oven of the invention (FIG. 4), with an upper/lower radiant element watt setting of 670/110, more radiant power is presented to the top surface of the cake than to the bottom surface of the pan. The additional heat energy is presented to the top surface to compensate for evaporative heat losses at the top of a product and to encourage baking from the top downward. This, in turn, makes possible the use of a baking pan with a high radiant power absorptivity (i.e., high emissivity) and a lower power setting for the lower radiant source.

As shown in FIG. 4 the total radiant power presented to a cake at any point in time in the bi-radiant oven of the invention is approximately 62 watts or about twice the radiant power available in a conventional oven even though the power usage for a conventional oven would be much higher, utilizing an element rated 2000–3000 watts, than that for the invention oven.

The emissivities, shown in Table 1, for the interiors of conventional and bi-radiant ovens indicate what occurs during the baking process. In a conventional, enamel-coated steel oven most (80%) of the infrared radiation striking the oven interior is absorbed, raising the temperature of the oven walls, reradiating some of the power back toward the product baking and conducting the remainder to the outside of the oven. In the bi-radiant oven of the invention, with walls of low emissivity, the greater portion (95%) of the radiant power is reflected back to the interior of the oven cavity and thence to the product being baked.

TABLE 1

| EMISSIVITIES | |
|---|---|
| OVEN WALLS | |
| Conventional Oven | 0.80 |
| Invention Oven | 0.05 |
| CAKE PAN BOTTOM SURFACE | |
| Conventional Oven | 0.077 |
| Invention Oven | 0.79 |

The emissivities, shown in Table 1, of the pan materials used also indicate what occurs during the baking process. In a conventional oven system, most (92%) of the radiant power is reflected away from the pan sides and bottom, which typically have a low emissivity, thus inhibiting the absorption of radiant power from the pan sides and bottom. Even so, cakes bake more quickly from the bottom up in a conventional oven because of the cooling effect due to evaporation heat losses at the top of the product. Thus, the last portion of a product to bake in a conventional oven is just under the top surface as shown in FIG. 5.

Figure 5:
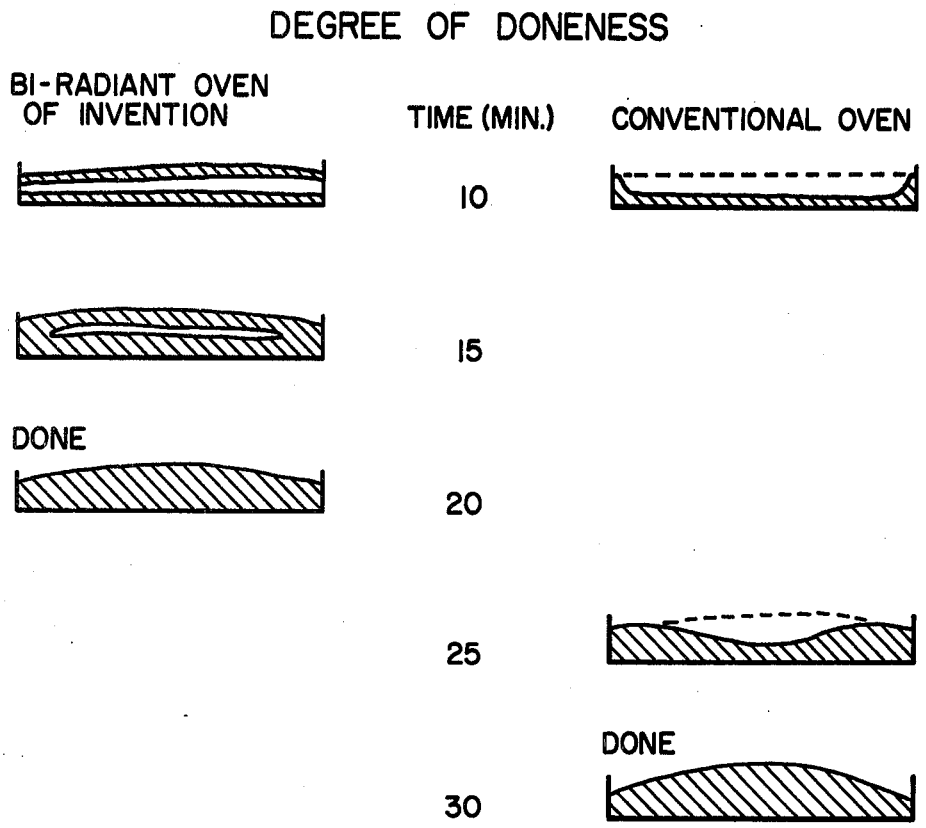
FIG. 5 illustrates, in timed sequence, the baking process of a food product in the invention oven as compared to a conventional oven.

FIG. 5 shows the time and degree of doneness for test cakes baked in the invention oven with upper/lower wattage settings of 670/110 compared to cakes baked in a conventional oven at a 350° F. setting. As shown, baking time is reduced since, in the invention oven, a food product is baked from both the top and bottom as opposed to the conventional oven wherein baking occurs only from the lower portion of the food product. Also, as before mentioned, the conventional oven would require usage of a 2000–3000 watt element to accomplish the cake baking process shown in FIG. 5.

Tables 2–5 show the results of a series of parametric studies that were conducted wherein baking pan and oven wall characteristics were varied in both the conventional oven configuration and the bi-radiant oven of the invention. In the conventional oven study, two oven lining emissivities and two cake pan bottom emissivities were used as the variable parameters. Similarly, for the bi-radiant oven study, two oven lining emissivities and two cake pan bottom emissivities were used as variable parameters. For each parameter, measurements of baking time (in minutes) and energy use (in kilowatt hours) were taken. Also, the finished product was evaluated to determine quality level. In the parametric studies, single layers of yellow cake were used as the test food since this product can be easily standardized and is a sensitive indicator of heat transfer into a food. Presenting too much heat, too little heat or heat at an uneven rate can each inhibit the delicate cake baking process that allows carbon dioxide to form and provide small air cells, allows an appropriate rate for the setting of protein and starch components of the batter, and allows surface browning.

TABLE 2

Comparison of energy use for baking single cake layer, two pan materials, two oven linings, conventional oven.

| | Energy Use - KWH Oven Lining | |
|---|---|---|
| | Porcelain Lining | Foil Lining |
| Pan Bottoms | (E = 0.80) | (E = 0.05) |
| Black (E = 0.79) | 0.410 | 0.186 |
| Standard (E = 0.077) | 0.620 | 0.320 |

TABLE 3

Comparison of baking time for baking single cake layer, two pan materials, two oven linings, conventional oven.

| | Baking Time - Minutes Oven Lining | |
|---|---|---|
| | Porcelain Lining | Foil Lining |
| Pan Bottoms | (E = 0.80) | (E = 0.05) |
| Black (E = 0.79) | 24 | 11 |
| Standard (E = 0.077) | 23 | 24 |

TABLE 4

Comparison of energy use for baking single cake layer, two pan materials, two oven linings, bi-radiant oven of invention.

| | Energy Use - KWH Oven Lining | |
|---|---|---|
| Pan Bottoms | (E = 0.79) | Shiny (E = 0.05) |
| Black (E = 0.79) | 0.406 | 0.246 |
| Shiny (E = 0.05) | 0.469 | 0.365 |

TABLE 5

Comparison of baking time for baking single cake layer, two pan materials, two oven linings, bi-radiant oven of invention.

| | Time in Minutes Oven Lining | |
|---|---|---|
| Pan Bottoms | Black (E = 0.79) | Shiny (E = 0.05) |
| Black (E = 0.79) | 22 | 18 |
| Shiny (E = 0.05) | 35 | 25 |

In the conventional oven study, two oven linings were used: conventional porcelain (E=0.80) and shiny aluminum foil (E=0.05). Also, two pan materials were used: standard dull aluminum bottom (E=0.077) and black coated foil bottom (E=0.79). Cakes were baked until the last portion of each was done.

Energy use ranged from a low of 0.186 KWH for a low emissivity foil oven surface and black bottomed pan to a high energy use of 0.620 KWH for the conventional baking conditions with a porcelain oven interior and a standard aluminum pan (Table 2). Baking time variations for the oven lining/pan material configurations also shows 11 minutes required when a low emissivity foil lining and black pan are used and 24 minutes for the conventional combination (Table 3).

Substantial energy and time savings are realized by improving either the oven lining or pan materal in the conventional, single lower element, high wattage oven and the savings are rather dramatic when both are altered. However, very importantly, cake qualtity cannot be maintained using these altered pan/oven lining configurations. Overall acceptability, volume, browning, and texture of cakes baked with other than standard configurations were unacceptable. Cakes baked in the foil lined oven in the black bottom pan were very coarse grained with large air holes and tunnels. Those baked using the shiny aluminum cake pan in the foil lined ovens were depressed in the center with decreased volume. Those cakes from the black bottom pan in the porcelain lined oven were small in volume and had thick top and bottom crusts.

Thus, the tests showed that altering the oven lining to make it more radiant energy reflective or altering the pan material to make it more radiant energy absorptive in a conventional oven are not satisfactory solutions. Products bake too quickly from the bottom of the product and are unacceptable in quality.

In the invention oven study, again two oven linings were used: shiny aluminum (E=0.05) and black aluminum (E=0.79). Also, two pan bottom materials were used: shiny aluminum (E=0.05), and black coated foil (E=0.79). Pan sides in all cases were shiny aluminum (E=0.05). Both an upper and lower element were used as opposed to only the lower element in a conventional oven. The upper element setting was 670 watts; lower element setting was 100 watts.

Energy usage for the same cake oven load as in the conventional oven parametric study ranged from 0.246 KWH for the shiny oven lining and black pan to 0.469 KWH for the black oven with a shiny pan (Table 4). Energy usage in any of these instances is less than that required by a single element in the conventional range with normal operation (0.620 KWH). Baking times ranged from 18 minutes for the shiny oven, black pan combination to 35 minutes for the black oven, shiny pan combination (Table 5). These results illustrate the superiority of the bi-radiant oven in presenting appropriately balanced infrared radiation from two directions.

As part of the parametric studies, cake samples were submitted to trained taste panels. Taste panel judges were unable to differentiate between cakes in the optimal bi-radiant oven system (i.e., the shiny oven, black pan combination) and those baked in a conventional oven system. Cakes baked with black oven walls and/or shiny aluminum pans in the bi-radiant oven were less acceptable, as well as requiring greater energy use and longer baking times.

To illustrate the evenness of baking in the bi-radiant oven, tests were made to compare temperatures at the edge and center of cakes baked in the bi-radiant oven and in a conventional oven.

In the conventional oven there was a 5°–8° C. temperature variation at any given time between the center and edge location within the cakes. This was true throughout the baking period. The edge temperature was consistently higher than the center location. Temperatures in cakes baked in the bi-radiant oven were less varied and after a short period were almost identical with center and edge temperatures of 78° C. and 79° C. respectively indicating that cooking takes place more uniformly in the bi-radiant oven than in the conventional oven.

At the end of the baking period the cake temperatures at the edge and center locations were the same in the bi-radiant oven, indicating more uniform heat absorption throughout the cake. In the conventional oven the temperature at the edge was 7°–8° C. higher than at the cake center during the baking process, indicating the edge was certain to be overcooked by the time the cake center was just done.

The bi-radiant oven provided the cake with constant and even heat from both top and bottom, resulting in a cake baked to more nearly the same degree throughout and with a shorter baking time as shown in FIG. 5. In a conventional oven, since heat transfer into the cake is primarily from the bottom and sides, cakes cannot attain the necessary done temperature on all parts of the cake as well without first overcooking the batter near the pan material.

To demonstrate the effectiveness of the bi-radiant oven for general baking and roasting processes, a number of foods were prepared in both a conventional oven and the bi-radiant oven of the invention. The energy saving results are shown in Table 6. Energy use for the bi-radiant oven would be further reduced with black bottom pans in the instances where they were unavailable. For the various foods tested, upper and lower radiant element settings of the bi-radiant were varied to accommodate the variety of heat transfer requirements of the assortment of foods cooked depending on the size, shape, conductivity and specific heat of the foods.

TABLE 6

Energy use for baking in conventional and bi-radiant oven of invention.

| Product | Conventional Energy Use KWH | Bi-radiant Energy Use KWH | Energy Reduction Percent |
|---|---|---|---|
| Augratin Potatoes | 1.962 | .375 | 80 |
| Biscuits | 1.237 | .172 | 86 |
| Yeast Bread | 1.145 | .237 | 79 |
| Baked Potatoes* | 1.280 | .762 | 40 |
| Sheet Cake | .910 | .391 | 57 |
| Meat Loaf** | 1.060 | .696 | 34 |
| Lasagna** | 1.286 | .545 | 58 |
| Frozen Pie | 1.568 | .475 | 71 |
| Two Layer Cake | 1.060 | .269 | 75 |

Energy use includes preheat for biscuits, yeast bread, cakes and pie. All other items were started in cold oven.

*No pan used
**Optimum pan not available

The most important advantage of the bi-radiant oven over a conventional oven is the use of less electrical energy. Energy use during baking or roasting of foods is substantially less compared to a conventional oven. Additionally, no preheat is required for even the most heat sensitive products, such as cakes and breads. This provides an additional energy savings for all foods requiring a preheated oven.

The bi-radiant oven bakes more evenly because radiant power is adjusted so that cooking occurs from the top of a product toward the center as quickly as it does from the bottom toward the center. Shorter cooking times are achieved for many food products since baking heat does not have to travel as far as previously discussed with regard to FIG. 5.

Heat loss from the oven is reduced because the low absorptivity of the oven walls inhibits the absorption of heat keeping them cooler and thus reduces unwanted heat conducted into the kitchen. Controlling the power of each element independently permits the selection of settings to accommodate a variety of foods to provide each with optimum cooking rates depending upon the processes required for an optimum product.

A conventional oven cavity could be conveniently modified to operate as a bi-radiant oven, eliminating costly manufacturing production changes.

Gas-fired low temperature radiant sources in lieu of electric elements could be effectively utilized in the invention system.

The bi-radiant oven system can be adapted for use in portable table ovens for small quantities of food or for commercial ovens for heating and cooking large quantities of foods. The system is also attractive for use in conveyor-type commercial ovens.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. An oven system comprising an oven cavity having inner top, bottom and side walls forming said cavity, one of said side walls having a door therein, a horizontal food product supporting rack member mounted within said cavity, wherein the improvement comprises:

an upper infrared radiant heat element mounted to one of said walls, said upper element being located above said food product supporting rack member;

a lower infrared radiant heat element mounted to one of said walls, said lower element being located below said food product supporting rack member;

said oven cavity walls having a low emissivity E and thus being highly reflective of infrared radiant heat energy;

a baking pan member within said oven cavity and positioned upon said food supporting rack member, the lower portion of said baking pan member having a high emissivity E and thus being highly absorptive of infrared radiant heat energy;

wherein said oven system has means for supplying infrared radiant energy directly to said baking pan member and a food product within said oven cavity from said upper and lower infrared radiant heat elements;

said oven system including control means for independently and simultaneously supplying power to said upper and lower infrared radiant heat elements and for adjusting said upper element to a first power setting and said lower element to a second power setting;

said upper infrared radiant heat element having a higher wattage rating than said lower infrared radiant heat element thus supplying more infrared radiant power to the top of a food product to counter the effect of evaporative heat losses during the baking process.

2. The oven system of claim 1 wherein said upper and lower infrared radient heat elements are electrical resistance heaters.

3. The oven system of claim 1 wherein said upper infrared radiant heat element has a maximum wattage rating of 1000 watts.

4. The oven system of claim 1 wherein said lower infrared radiant heat element has a maximum wattage rating of 500 watts.

5. The oven system of claim 1 wherein said control means includes means for providing continuous operation of said upper and lower infrared radiant heat elements during the baking process thereby avoiding on-off cycling of said elements during operation of said oven system.

6. The oven system of claim 1 wherein said upper and lower infrared radiant heat elements are in direct radiant heat transfer contact with said food product and said baking pan lower portion.

7. The oven system of claim 1 wherein said oven cavity walls have an emissivity E value of less than 0.10.

8. The oven system of claim 7 wherein said lower portion of said baking pan member has an emissivity E value greater than 0.70.

9. The oven system of claim 1 wherein said oven cavity walls are constructed of shiny aluminum metal.

10. The oven system of claim 9 wherein said baking pan lower portion is constructed of black coated aluminum metal.

11. The oven system of claim 1 including means whereby said upper infrared radiant heat element attains a maximum operating temperature of 400° C.

12. The oven system of claim 1 including means whereby said lower infrared radiant heat element attains a maximum operating temperature of 200° C.

* * * * *